US006589363B2

(12) United States Patent
Rohde et al.

(10) Patent No.: US 6,589,363 B2
(45) Date of Patent: Jul. 8, 2003

(54) METHOD FOR MAKING HEAT TREATED STAINLESS HYDRAULIC COMPONENTS

(75) Inventors: Daniel P. Rohde, Springfield, IL (US); John N. Tackes, Lake Zurich, IL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/735,962

(22) Filed: Dec. 13, 2000

(65) Prior Publication Data

US 2002/0112795 A1 Aug. 22, 2002

(51) Int. Cl.[7] ..... C21D 7/00

(52) U.S. Cl. ..... 148/226; 148/230; 148/605; 148/607

(58) Field of Search ..... 148/307, 325, 148/327, 318, 607, 605, 608, 610, 226, 230

(56) References Cited

U.S. PATENT DOCUMENTS 4,588,440 A * 5/1986 Simoneau ..... 148/325
5,257,453 A * 11/1993 Neumann et al. ..... 29/888.4
5,513,671 A 5/1996 Cortopassi et al. ..... 137/99
5,802,937 A 9/1998 Day et al. ..... 82/111

FOREIGN PATENT DOCUMENTS

FR 26895921 A 7/1993

OTHER PUBLICATIONS

English abstract of Japanese patent 1318763A, published Jun. 20, 1988.*
Carpenter Technology Corporation, "Guide to Selecting Stainless Steels for Pumps, Valves and Fittings", 1981.

* cited by examiner

*Primary Examiner*—Deborah Yee
(74) *Attorney, Agent, or Firm*—Daniel S. Kalka; L. J. Kasper

(57) ABSTRACT

A stainless steel hydraulic component and method for making same hard turns a pre-heat treated stainless steel material, preferably a 400 series stainless steel material, provided in bar stock form in a single machining loading. Stainless steel hydraulic valve components made therefrom have shown improved leakage rate performance with the performance being fairly constant over a period of time for providing a longer functional life for the hydraulic valve component.

5 Claims, 2 Drawing Sheets

METHOD FOR MAKING HEAT TREATED STAINLESS HYDRAULIC COMPONENTS

BACKGROUND OF THE INVENTION

1. Filed of the Invention

The present invention relates in general to stainless steel hydraulic components, and more particularly to a method of using and manufacturing hydraulic components from pre-heat treated stainless steel.

2. Description of the Related Art

Hydraulic components must be produced or finished within very close tolerances, i.e., to precision finished dimensions. Currently, most hydraulic components like check valves, poppet valves, or sliding spool valves are produced from carbon or alloy steel and are subjected to a variety of machining, turning, grinding, or cutting process steps necessary to form the component to its precision finished dimension for the completed product.

In the manufacturing process of such hydraulic components, the typical process usually requires at least one turning or machining step followed by a final heat treatment step to provide suitable hardenability to the hydraulic component. As a result, it is more difficult to establish part finishes, geometrical requirements, and dimensional tolerance constraints. This can result in the requirement for more processing time and cost involved in producing a desired part from a selected carbon steel material.

Stainless steel is a material currently used primarily in corrosive environments. Stainless steel is commonly understood to mean a corrosion resistant alloy steel containing approximately 10.5% or more on a weight percent basis, chromium (Cr). Stainless steel (SS) offers strength (approximately 50% stronger than low carbon steels), heat and corrosion resistance, and low maintenance.

Stainless steel materials are widely used for specific industry applications like fasteners, spindles, nozzles, shafts, springs, surgical instruments, etc. as well as in many aerospace and automotive applications. Cast stainless steel has also been employed in some hydraulic valve applications, like fabricating the body and bonnet, wedge, seat ring, stem gland, bonnet bush, yoke sleeve, etc.

The practice of hard turning pre-heat treated stainless steel material to eliminate the need for post turning heat treatment has been employed for some steam flow applications in the electrical power generation industry. However, this practice to the best of the inventors' knowledge has not been applied to stainless steel materials in the hydraulics industry. One skilled in this art is not likely to consider these materials for hydraulic components due to a number of factors including, but not limited to the size of the hydraulic components, the hardness of the stainless steel material, and the difficulties involved with machinability of heat treated stainless steel materials. It is generally known that hardenability decreases as machinability increases. Also, the higher cost of stainless steel relative to carbon steel makes it cost prohibitive for use in the hydraulics industry.

There still exists a need for improved hydraulic components and an improved method for making the hydraulic components. The improved hydraulic components should be made from stainless steel and be more durable, more corrosion resistant, and exhibit improved leak performance over time. The improved method should eliminate secondary process steps along with the extra costs associated therewith. Such a method would make a stainless steel material a cost-effective alternative after processing costs and life cycle cost are compared to other materials.

BRIEF SUMMARY OF THE INVENTION

Accordingly, it is an object of the present invention to provide an improved hydraulic component made from a pre-heat treated stainless steel material.

Another object of the present invention is to provide a method for making a stainless steel hydraulic component that offers improved performance, corrosion protection, durability, and low maintenance throughout the manufacturing process and life cycle of the product.

Another object of the present invention to provide a method for manufacturing a stainless steel hydraulic component in a cost-effective manner while providing a superior quality product with a shorter fabrication cycle.

Still another object of the present invention is to provide a stainless steel valve component of the sealing type with improved leak performance over a period of time.

A further object of the present invention is to provide a stainless steel valve component of the sealing type with a constant leakage rate over a period of time.

The above and other objects of the present invention are accomplished with a method that hard turns a selected pre-heat treated stainless steel material to precision finished dimensions.

The method according to the present invention comprises the steps of: selecting a pre-heat treated stainless steel material having a predetermined minimum hardness value; providing the selected heat-treated stainless steel material in a bar stock form; and machining a hydraulic component to a finished dimension in a single machining operation.

The present invention is also directed to hydraulic valve components made of a selected stainless steel material having a predetermined minimum hardness value and a maximum ferrite content.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is described and illustrated.

DETAILED DESCRIPTION OF THE INVENTION

Figure 1:
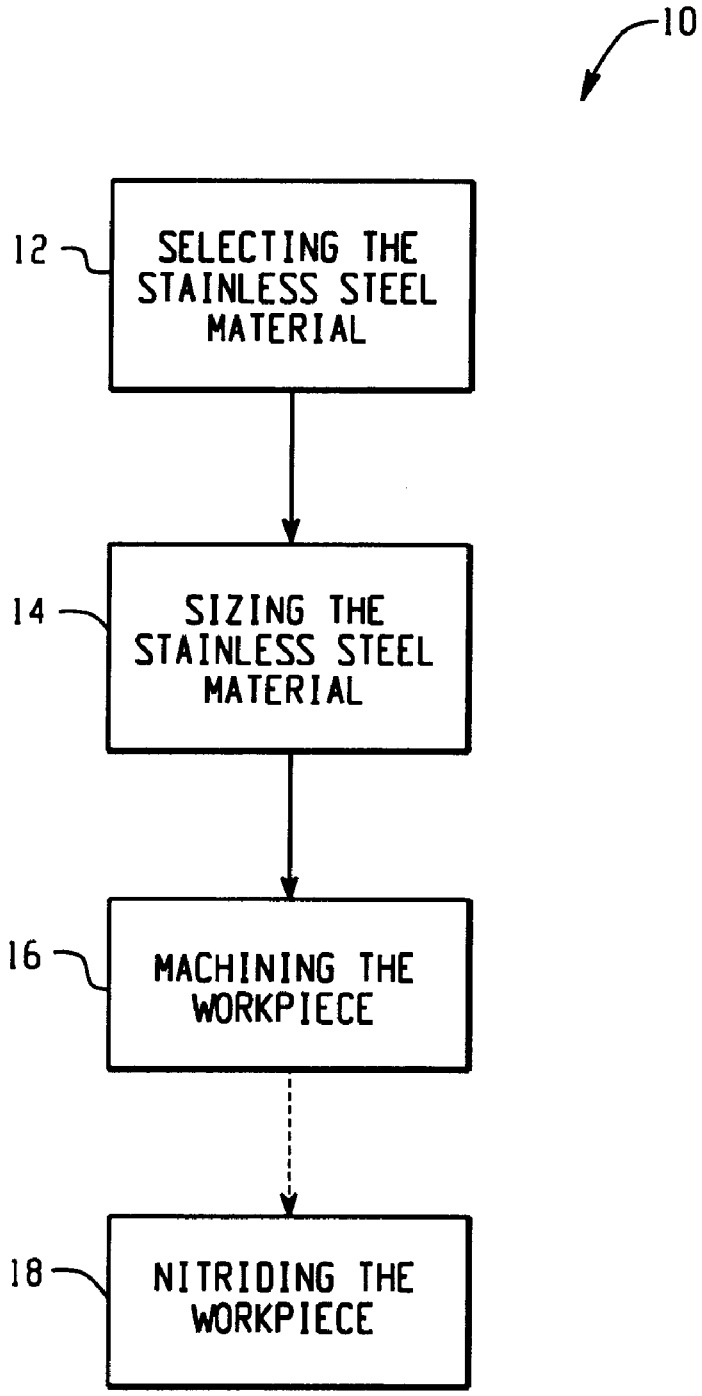
FIG. 1 is a block diagram of the method in accordance with the present invention.

Referring to the figures, which are not intended to limit the invention, and first in particular to FIG. 1, there is shown a block diagram of the steps of the method 10 in accordance with the present invention.

The first step 12 in the process according to the present invention is the step of selecting a suitable stainless steel material for an intended hydraulic component. The preferred material employed in the present invention is a stainless steel material selected from the 400 grade or series, for example, an AISI (The American Iron and Steel Institute)

400 series stainless steel material. The 400 series stainless steel material offers strength, heat and corrosion resistance, formability, as well as a pleasant aesthetic appearance and low maintenance. The 400 series stainless steel material is hardenable by heat treatment and available in a bar stock form. Some examples of a 400 series or grade stainless steel include, but are not limited to, AISI types 403, 405, 410, 414, 416, 420, 430, and 440. Chromium content ranges from a minimum of about 11% to about 16% on a weight percent basis and nickel content may range up to about 2%.

The term martensitic stainless steel is a term well known in this industry and refers to a stainless steel material having chromium content ranging from about 12 to about 18% on a weight percent basis and a moderate carbon content, i.e., containing more than about 0.08% (wt. %) carbon. These types of steel are hardenable by heat treatment, for example, quenching and tempering like a plain carbon steel, and are suitable for use with the present invention. Representative types of stainless steel material suitable for use in the present invention have the following chemical compositions, as is known in the industry, with all of the values of the elements being provided on a weight percent basis (wt. %).

| | 416 | 410/403 | 420 |
|---|---|---|---|
| C | 0.14 | 0.130 | 0.34 |
| Si | 0.34 | 0.310 | 0.43 |
| Mn | 0.94 | 0.420 | 0.41 |
| P | 0.028 | 0.016 | 0.02 |
| S | 0.280 | 0.005 | 0.002 |
| Ni | 0.40 | 0.260 | 0.24 |
| Cr | 12.83 | 11.940 | 12.34 |
| Mo | 0.06 | 0.190 | 0.07 |
| Cu | 0.04 | 0.150 | 0.07 |
| N | 0.0335 | 0.051 | — |
| Mo + Zr | 0.062 | — | — |
| Co | — | 0.050 | 0.03 |
| Al | — | 0.0100 | 0.003 |

It should be understood that the above samples are representative of only some of the materials suitable for use in the present invention and the above list is not intended to be all inclusive. The above materials are commercially available from the following suppliers, including, but not limited to, A.M. Castle & Co., Fry Steel Company, Central Steel and Wire Company, and Al Tech Specialty Steel Corp.

Martensitic stainless steel materials are hardenable by heating above the crucial or transformation temperature, and then rapidly cooling in oil or air. Proper selection of grades and of primarily carbon and chromium content provides a wide range of "as quenched hardness" for a variety of applications. The martensitic stainless steel material offers maximum corrosion resistance in the hardenable condition and may be annealed for best cold working and/or machining characteristics. Preferably, a type 416 stainless steel material is used which conforms to American Society of Testing Materials (ASTM) specifications A-276 or A-582, condition H or Y (annealed or not annealed), to obtain optimal core hardness. This core hardness is sufficient to accommodate nitriding after machining when nitriding is desired. It should be understood that nitriding is not a requirement of the present invention but may be desired for the hydraulic component or for specific locations on the hydraulic component, for example, the threaded male portions. The selected stainless steel material in the present invention preferably has a minimum hardness of about 26 HRC (Rockwell hardness value or equivalent unit of measure), and has preferably less than about 2% (wt. %) ferrites. The present invention is applicable to a pre-heat treated stainless steel that is capable of being machined in a hardened form.

The preferred pre-heat treatment of type 416 SS material includes a heat treatment ranging from about 1700°–1750° F. for approximately one hour followed by air cooling. The material undergoes double tempering at about 600° F. for approximately two hours with air cooling between the tempering steps. In the annealed condition, the material has a hardness of about 222 BHN (Brinell hardness value). The resultant hardness after heat treatment is about 400 BHN.

The next step 14 in the process 10 of the present invention is the sizing step. This step includes the step of providing the selected pre-heat treated stainless steel material in a desired size of bar stock form. For illustrative purposes only, a type 416 SS material is ordered as a rod with a diameter of about ½ inch and a length of about twelve feet. This size and shape can be loaded directly into a two-axis CNC lathe. Of course it should be immediately apparent that any size or shape desired may be employed with the process of the present invention depending upon a desired application or an intended hydraulic component. It should be further understood that the sizing step can optionally include cutting the bar stock to a predetermined size to allow for direct feeding into a lathe or similar unit.

The machining step 16 in accordance with the present invention uses any conventional machining operation such as the two-axis CNC lathe to machine the hydraulic component in one setup or single machine loading or operation. The material is removed in multiple, single passes referred to as turning. Since the "turning" is conducted on a pre-heat treated hardened material, this step is referred to herein as "hard turning". The term "machining" as used herein is meant to include any machining operation including, but not limited to, milling, drilling, boring, reaming, grinding, polishing, and threading. When the hydraulic component is removed from the machine, it is a completed part made to a precision finished dimension. Advantageously, the process uses indexable carbide cutting tools readily available in the market and typically already in use on these machines. The method of the present invention includes providing the stainless steel material at a slightly higher feed rate with a lower rpm (revolutions per minute) than a carbon steel material. The lubricants used for the turning operation are soluble water based coolants also commercially available in the market and known to those skilled in this art.

Step 18 of the present invention optionally includes any post machining steps including, but not limited to, nitriding or heat treatments. Endurance tests conducted on the performance or life cycle of check valves did not indicate any significant affect of nitriding. Further testing on subsequent hydraulic components or portions thereof may reveal nitriding to be of some benefit to the performance or life cycle. Nitriding is done in a conventional manner well known in the industry.

Figure 2:
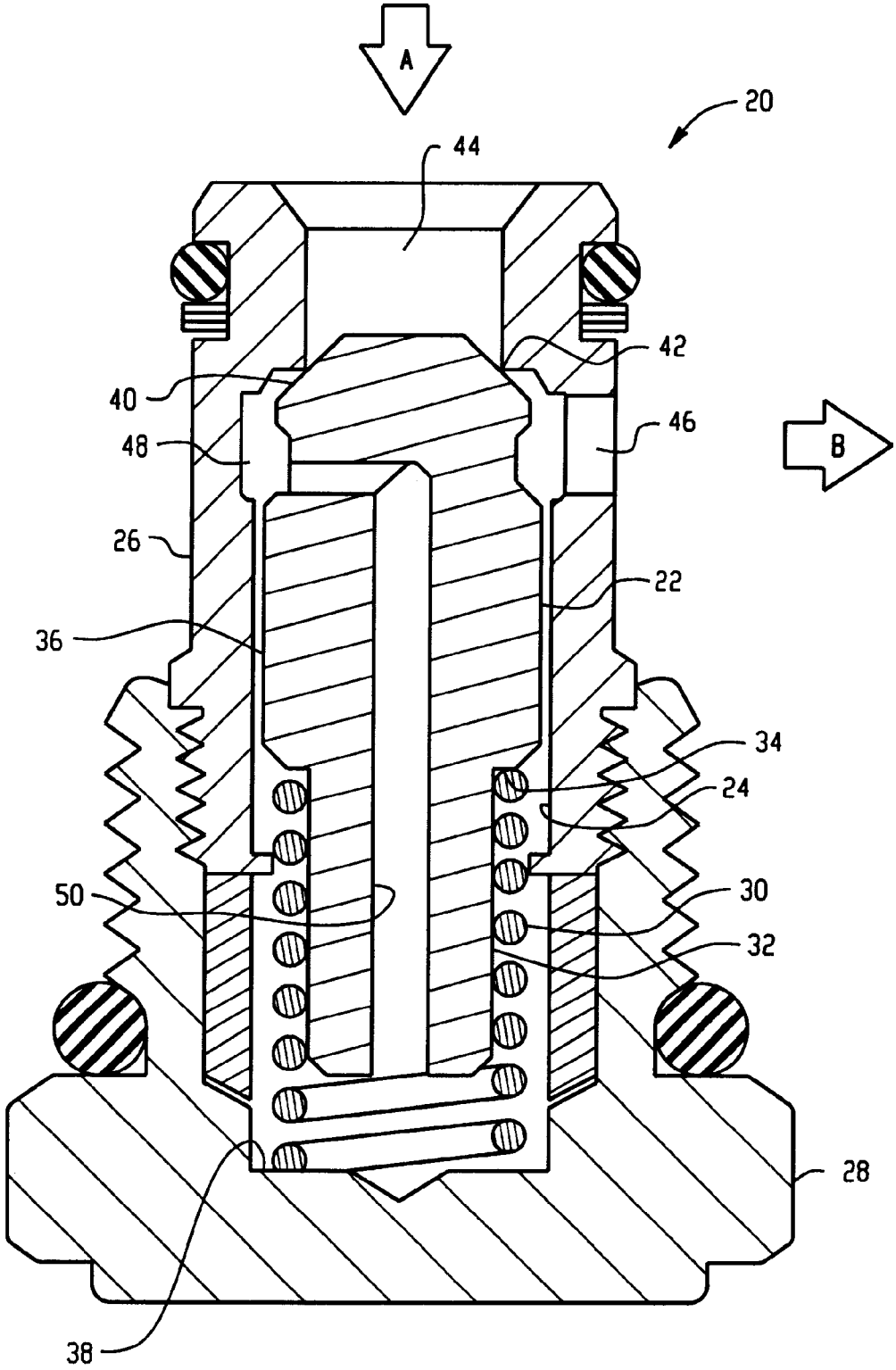
FIG. 2 is a sectional view of a check valve assembly including components made in accordance with the present invention.

Turning next to FIG. 2, there is shown in sectional view a check valve 20. Check valve 20 is a device well known in this art. A brief explanation of its structure and operation will provide a better understanding of the present invention. Check valve 20 has a poppet valve 22 resiliently biased within a bore 24 of a cage 26. Cage 26 s threadably received within a retainer 28. A spring 30 surrounds a first cylindrical portion 32 of the poppet valve 22 and is retained thereon by one end of the spring 30 abutting a shoulder 34 of a second cylindrical portion 36 having a larger diameter than the diameter of the first cylindrical portion 32. The other end of spring 30 abuts the base 38 of the retainer 28 for biasing a poppet face 40 of the poppet valve 22 against a seat 42 of the cage 26. Cage 26 further includes ports 44, 46 fluidly communicating with a chamber 48 therein.

Poppet valve 22 is typically biased in a closed position as shown in FIG. 2. Fluid flow in the direction of arrow A in port 44 exerts a fluid pressure greater than the biasing force of spring 30 to open the poppet valve 22. The fluid exits through chamber 48 and out port 46 in the direction of arrow B. When the fluid pressure entering port 44 is reduced to a point where the biasing force of spring 30 is greater than the fluid pressure, the poppet valve 22 moves to its closed position. A passage 50 through poppet valve 22 in fluid communication with chamber 48 utilizes fluid pressure to fluidly assist the biasing force of spring 30 for a sealing engagement of poppet face 40 against cage seat 42.

The process 10 of the present invention was used to produce the following hydraulic components from the given materials. Their hardness values are given in Brinell units or Rockwell units of measurement. Only the cage 26 and poppet valve 22 were made of stainless steel material in these examples. The retainer 28 was made from a carbon steel. For illustrative purposes only, the outer diameter (O.D.) of poppet valve 22 was machined on the 2-axis CNC lathe in a finisher and roughing step that employed a SANDVIK, a registered trademark of Sandvik Aktiebolag Corporation, (cat. no. VNMG332-MM 2015 m 15) turning tool with the lathe operating at about 600 sfm (surface feet per minute) and a feed rate of about 0.003 inches per revolution (ipr). The O.D. turning for the angle seat area (poppet face 40) employs a VALENITE (VLG-20262R) VL929 turning tool. VALENITE is a registered trademark of Valenite Inc. The lathe operates at approximately 90 rpm with a feed rate of 0.0015 ipr. Carbide drills having a C2 grade of carbide were employed for drilling the passage 50 in poppet valve 22. Initially a carbide center drill having a diameter of approximately 0.060 inch was used at a speed of about 1562 rpm with a feed rate of about 0.004 ipr. This was followed by a drill at a speed of about 3000 rpm and a feed rate of about 0.002 ipr. A 7/64 inch drill was used for the 90° angled portion of passage 50. The operating speed was about 3000 rpm with a feed rate of about 0.0015 ipr. A 3/64 inch ball endmill operating at about 4500 rpm was employed next with a feed rate of about 0.7 inch per minute. The cutoff tool was an ISCAR (DGN 3102J IC328) at about 2500 rpm with a feed rate of 0.002 ipr. ISCAR is a trademark of ISCAR Ltd.

The difference of machining characteristics of aluminum, carbon steel, and stainless steel may be illustrated as follows:

| Material | Hardness | Power Requirement |
|---|---|---|
| Aluminum alloys | 30–150 BHN | 0.25 |
| Steels | | |
| plain carbon | 35–40 HRC | 1.4 |
| alloy | 40–50 HRC | 1.5 |
| tool | 50–55 HRC | 2.0 |
| Stainless steel (ferritic, austenitic, martensitic) | 30–45 HRC | 1.4 |
| Stainless steel | 150–450 BHN | 1.2 |

The power requirement is based on average unit power requirements of spindle drive motor corrected for approximately 80% spindle efficiency for turning using sharp tools. Units are in horsepower per cubic inch per minute.

| Part and material Used | Material Hardness |
|---|---|
| Cage Material 416 Stainless Steel | 187 BHN |
| Poppet material 410 Stainless Steel-Nitrided | 222 BHN then (15 n) |
| Cage Material 410 Stainless Steel | 222 BHN |
| Poppet material 416 Stainless Steel-Not Nitrided | 28 HRC |
| Cage Material 416 Stainless Steel | 28 HRC |
| Poppet material 416 Stainless Steel-Nitrided | 28 HRC then (15 n) |
| Cage Material 416 Stainless Steel | 28 HRC |
| Poppet material 416 Stainless Steel-Not Nitrided | 28 HRC |
| Cage Material 420 Stainless Steel | 222 BHN |
| Poppet material 420 Stainless Steel-Nitrided | 222 BHN then (15 n) |
| Cage Material 410 Stainless Steel | 222 BHN |
| Poppet material 420 Stainless Steel-Not Nitrided | 222 BHN |

The check valves were assembled and tested with a standard valve endurance test of at least 1,000,000 cycles (a cycle is the opening and closing of the check valve) to determine functional life and leakage of the valves. The tested valves had a rated pressure of about 5750 psi (pounds per square inch) with a flow rate of about 20 GPM (gallons per minute). The fluid employed was a Mobil DTE 24 oil heated to a temperature of 180 degrees F. Port 44 was the inlet port and port 46 the outlet port. Leakage was checked at port 44 with a pressure of about 500, about 3000, and about 5200 psi at port 46. An on-off cycle ranged from about 0.3 to 0.5 second. Valve leakage was checked approximately every 250,000 cycles.

The results indicated that the materials tested could be used in any combination (i.e., on the cage and poppet valve) and still provide favorable results. The test results showed that even after 1,000,000 cycles the leakage rate remained fairly constant over time at about 0 to 1 drops per minute. The normal leakage rate for materials currently used such as the carbon steels for a fluid having the same viscosity is about 0 to 5 drops per minute when new, and about 0 to 15 drops per minute after 1,000,000 cycles. Performance of the valve deteriorates as a function of time. Since the leakage rate for the hydraulic components made in accordance with the present invention did not change and remained fairly constant over a period of time, it appears that the selected stainless steel material is a work-hardening material.

The poppet valve 22 used in check valve 20 has finish and roundness specification values of 16 RMS finish and roundness of 0.00005 inch. All of the poppet valves produced in accordance with the present invention had a roundness ranging from about 0.00002 to about 0.00003 inch during the turning operation with a surface finish of about 30–43 RMS. All values are well within the specifications.

The above results show that the 400 series stainless steel hydraulic valve components perform better than carbon steel in leakage rate tests and can be machined to precision finished dimensions well within specifications.

It should be immediately apparent to those skilled in this art that the present invention is applicable to other hydraulic components and is not limited to a check valve or its components. The process of the present invention may be used to make a wide variety of hydraulic components for different applications.

While specific embodiments of the invention have been shown and described in detail to illustrate the application of the principles of the invention, it will be understood that the invention may be embodied otherwise without departing from such principles.

We claim:

1. In a method for making a hydraulic valve component, the improvement comprises the step of hard turning a pre-heat treated hardened martensitic stainless steel material in bar stock form in one setup to make a completed hydraulic valve component with a precision finished dimension having close tolerances.

2. A method as recited in claim 1, wherein the pre-heat treated hardened martensitic stainless steel material comprises a 400 series stainless steel material.

3. A method for making a stainless steel hydraulic component, comprising the steps of:

selecting a pre-heat treated hardened martensitic stainless steel material having a hardness value ranging from about 222 BHN to about 400 BHN;

providing the selected pre-heat treated hardened martensitic stainless steel material in bar stock form; and machining a hydraulic valve component from the pre-heat treated hardened martensitic stainless steel material to a finished dimension having close tolerances in a single machining operation.

4. A method as recited in claim 3, wherein said pre-heat treated hardened martensitic stainless steel material further includes a maximum ferrite content equal to or less than about 2% on a weight percent basis.

5. A method as recited in claim 3, further comprising the step of nitriding at least a portion of the hydraulic component after the machining step.

* * * * *